US010960674B2

(12) United States Patent
Black

(10) Patent No.: US 10,960,674 B2
(45) Date of Patent: Mar. 30, 2021

(54) RESERVOIR AND BUBBLE STRUCTURE

(71) Applicant: HEWLETT-PACKARD DEVELOPMENT COMPANY, L.P., Spring, TX (US)

(72) Inventor: William Black, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/481,648

(22) PCT Filed: Feb. 28, 2017

(86) PCT No.: PCT/US2017/019834
§ 371 (c)(1),
(2) Date: Jul. 29, 2019

(87) PCT Pub. No.: WO2018/160159
PCT Pub. Date: Sep. 7, 2018

(65) Prior Publication Data
US 2019/0389223 A1 Dec. 26, 2019

(51) Int. Cl.
*B41J 2/175* (2006.01)
*B41J 2/19* (2006.01)

(52) U.S. Cl.
CPC ..... *B41J 2/17513* (2013.01); *B41J 2/1753* (2013.01); *B41J 2/17546* (2013.01); *B41J 2/17556* (2013.01); *B41J 2/19* (2013.01); *B41J 2002/17516* (2013.01)

(58) Field of Classification Search
CPC .. B41J 2/17513; B41J 2/1753; B41J 2/17546; B41J 2/17556; B41J 2/19
See application file for complete search history.

(56) References Cited

U.S. PATENT DOCUMENTS

| | | | | |
|---|---|---|---|---|
| 6,955,427 | B2 | 10/2005 | Takata | |
| 9,334,412 | B2 | 5/2016 | Aruga et al. | |
| 2002/0130933 | A1 | 9/2002 | Chan et al. | |
| 2003/0038866 | A1 | 2/2003 | Yu | |
| 2006/0017790 | A1 | 1/2006 | Jin | |
| 2008/0074479 | A1 | 3/2008 | Santos | |
| 2008/0143774 | A1 | 6/2008 | Morgan | |
| 2015/0275012 | A1 | 10/2015 | Ikeda et al. | |
| 2016/0009100 | A1* | 1/2016 | Kudo | B41J 2/175 347/92 |

FOREIGN PATENT DOCUMENTS

| | | |
|---|---|---|
| CN | 203198406 U | 9/2013 |
| EP | 1431040 | 6/2004 |
| JP | H0768782 | 3/1995 |
| JP | 2000043288 | 2/2000 |
| JP | 2013146977 A | 8/2013 |

* cited by examiner

*Primary Examiner* — Jason S Uhlenhake
(74) *Attorney, Agent, or Firm* — Fabian VanCott

(57) ABSTRACT

Different examples of systems, reservoirs and methods are described. One of these examples involves includes a reservoir with a liquid outlet through which liquid is to exit the reservoir. The reservoir may further include a bubbler structure to supply air to the inner volume of the reservoir, the bubbler structure includes an air outlet.

20 Claims, 5 Drawing Sheets

RESERVOIR AND BUBBLE STRUCTURE

BACKGROUND

This disclosure discusses liquid dispensing systems including two-dimensional and three-dimensional print systems. These systems are provided with fixed or replaceable printheads that dispense liquid such as inks or agents onto print media such as paper or powder. In certain instances, replaceable cartridges containing print liquid connect to the system to supply the printer's printhead with liquid during printing. After a certain amount of print events the cartridge will be exhausted. When liquid is consumed at a relatively high rate, cartridges need to be replaced at a regular rate to replenish the system with liquid.

Certain liquid supply stations and reservoirs are adapted to supply larger amounts of liquid. For example, relatively large bottles or buffers may supply liquid to a liquid tank that is part of the print system. In some instances, after having filled the tank by emptying the bottle, the tank is closed with a lid to avoid that too much air enters the system. The bottle may be disposed. The tank contains a large amount of print liquid so that the print system can continue printing without interruption for a relatively long time without needing to replenish the system with a newly filled reservoir. Typically the tank is placed vertically under printhead nozzles of the system to avoid a too high pressure head.

DRAWINGS

DESCRIPTION

Figure 1:
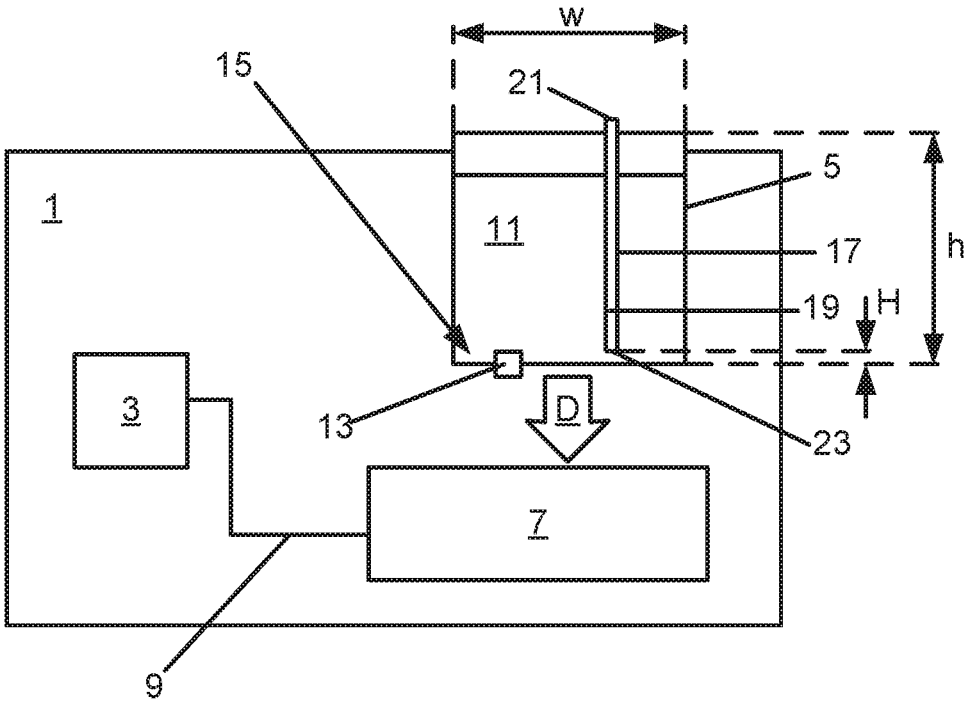
FIG. 1 illustrates a diagram of an example of a liquid dispense system.

FIG. 1 illustrates a liquid dispense system 1. The liquid dispense system 1 may be a high precision digital liquid dispense system such as a two-dimensional inkjet print system or a three-dimensional print system. The liquid dispense system 1 includes at least one fixed or replaceable dispense head 3 to dispense print liquid. The dispense head 3 may from hereon after be referred to as printhead 3 for ejecting drops of print liquid. The print liquid can be at least one of ink and 3D printing agent. The liquid dispense system 1 is to connect to a print liquid reservoir 5. The liquid dispense system 1 includes a receiving station 7 to receive the reservoir 5. The receiving station 7 is to establish a fluidic interconnection with the reservoir 5. A liquid delivery system 9 may be provided between the receiving station 7 and the printhead 3, to deliver liquid from the reservoir 5 to the printhead. The liquid delivery system 9 may include tubes and in some examples a passive or active pressure regulating structure.

In an example, the liquid dispense system 1 is adapted to function as a continuous ink supply system (CISS), for example adapted to be replenished with ink (or 3D print agent) from a relatively large ink (or agent) buffer, during relatively long periods and for high amounts of media, without needing to replace the reservoir. For example, while typical print systems may be adapted to receive replaceable cartridges of several milliliters or several tens of milliliters, CISS-type print systems of similar characteristics may be adapted to receive larger ink buffers of, for example several hundreds of milliliters. In one example, the reservoir 5 of this disclosure functions as such a CISS buffer. In contrast to other CISS buffers, in certain examples of this disclosure, the reservoir 5 may be adapted to be retained to the dispense system 1 during printing, and to supply relatively large amounts of liquid during printing at a relatively constant pressure head.

In the illustrated example the reservoir 5 holds a liquid 11 in its inner volume. The reservoir 5 is illustrated in the installation, or operational, orientation, just before it is installed. In the installation orientation the reservoir 5 includes a liquid outlet 13 near its bottom 15. For example, the liquid outlet 13 may connect with a liquid receive structure of the receiving station 7 by installing the reservoir 5 to the station 7 in a downward (D) pushing motion. Print liquid may than exit the reservoir 5 through the liquid outlet 13 in the downwards direction D in the installed condition.

The reservoir 5 includes a bubbler structure 17. The bubbler structure 17 includes an air channel 19 to bubble air into the inner volume of the reservoir 5. In the illustrated example the bubbler structure 17 is a tube-like structure. The bubbler structure 17 includes an air inlet 21 and an air outlet 23 at opposite extremes of the air channel 19. In the illustrated example, the air inlet 21 allows atmospheric air to flow in. In another example air may flow into the air inlet 21 by an active gas or air supply that is part of the liquid dispense system 1. The air outlet 23 may allow air to flow into the inner volume, for example in the form of bubbles.

The air outlet 23 of the bubbler structure is disposed just above the bottom 15 of the inner volume of the reservoir 5, in an installed orientation of the reservoir 5. A height level H of the air outlet 23 may be defined by the distance between a nearest portion of the bottom 15 and the circumferential edge of the outlet 23. When liquid exits the liquid outlet 13 and the bubbler structure 17 is functioning, the height level H of the air outlet 23 determines the pressure head of the liquid. In operation, while a top surface of the liquid is still higher than air outlet 23, the head of the liquid in the reservoir 5 is approximately equal to the head of the liquid column measured from said height level H downwards. Hence, by electing a height level H of the outlet 13 the pressure head may be maintained at a desirable, e.g., low, and steady level, at least until the liquid surface reaches a lower level. In turn this may reduce a risk of liquid leaking from a printhead, even when the reservoir holds a relatively large liquid volume. In certain examples the reservoir 5 may contain more than 0.1 liters, more than 0.3 liters, or more than 0.5 liters of print liquid; the height h of the reservoir 5 may be more than its width w; and the air outlet 13 may be at approximately 2 to 50 or 3 to 40 millimeters distance from the bottom 15 of the inner volume of the reservoir 5.

Figure 2:
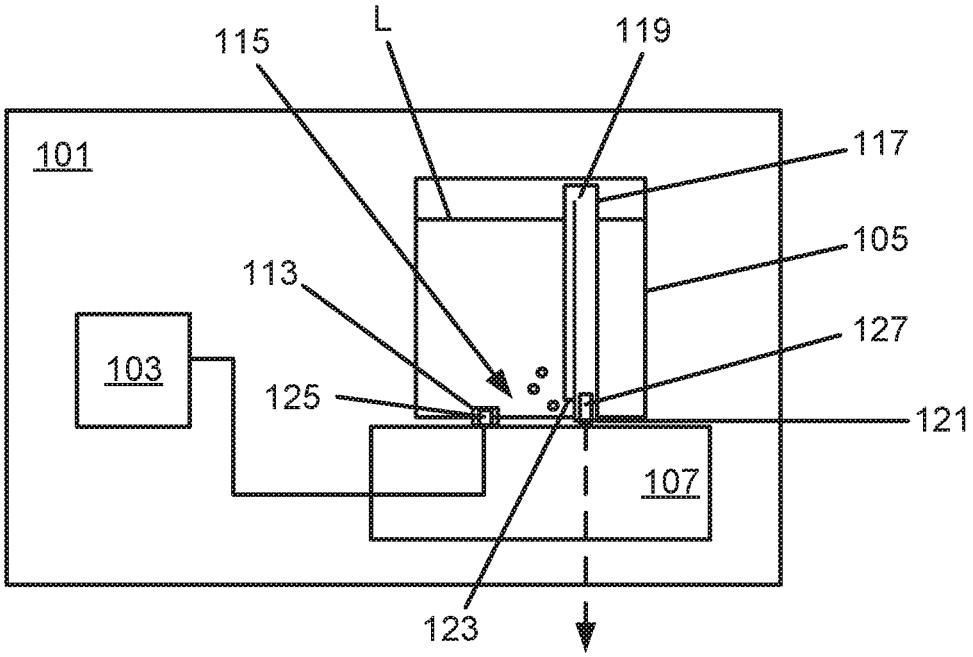
FIG. 2 illustrates a diagram of another example of a liquid dispense system.

FIG. 2 illustrates another example of a liquid dispense system 101. In the illustrated example, the liquid reservoir 105 is installed to the receiving station 107. This example system 101 has a bubbler structure 117 of which both the air inlet 121 and the air outlet 123 open near the bottom 115 of the inner volume 123 of the reservoir 105. In the illustrated example, the air channel 119 makes an approximately 180 degrees turn at its top. Similarly, a central axis of the air channel 119 extends mostly vertically and includes a 180 turn. The central axes of the air input 121 and air outlet 123 are parallel and extend vertically. The air outlet 123 opens into the reservoir's inner volume slightly above the bottom 115 and the air inlet 121 may extend through the bottom 115. For example, the air outlet 123 may extend between 2 and 50 millimeters above the bottom inner wall 115, or between 3 and 40 millimeters. Another example reservoir 105, not illustrated could an air inlet 121 and liquid outlet 113 that both project from the bottom of the reservoir 105.

The receiving station 107 includes a protruding liquid inlet tower 125 to connect to the liquid outlet 113. The receiving station includes a protruding air outlet tower 127 to connect to the air inlet 121. In operational condition the towers 125, 127 may extend vertically upwards. In the illustrated example the towers 125, 127 extend into the liquid outlet 113 and air inlet 121, respectively, facilitating liquid flow from the reservoir 105 through the liquid inlet tower 125. At installation the towers 125, 127 may push-open seal structures of the liquid outlet 113 and air inlet 115, respectively, thereby breaking a vacuum inside the reservoir while at the same time establishing a fluidic connection. In an example the towers 125, 127 pierce through the sealing structures at installation. Before installation, the reservoir 105 is filled and vacuum sealed. The walls of the reservoir 105 and the seals of the liquid outlet 113 and air inlet 115 include at least one air and liquid tight barrier layer. The volume of the vacuum may be at least the volume of the air channel 119.

In an example the system 101 is adapted to first establish the air connection and then establish the liquid connection, between the reservoir 105 and the receiving structure 107, in a single installation movement. For example, each of (i) the assembly of towers 125, 127 and/or (ii) the assembly of the liquid outlet 113 and air inlet 121 are configured so that air outlet tower 127 first opens the air inlet 121 and subsequently the liquid inlet tower 125 opens the liquid outlet 113, wherein both opening events are part of the same installation event. In the illustrated example both respective seals and/or openings of the liquid outlet 113 and the air inlet 121 may be positioned at an approximately similar level near the bottom 115 of the reservoir 105. The air outlet tower 127 may be higher or longer than the liquid inlet tower 125 to open the air inlet 121 before opening the liquid outlet 113.

When installing the reservoir 105, the air inlet 121 is opened, thereby replacing the vacuum with air, basically switching on the bubbler function of the bubbler structure 117. A moment later, yet in the same install movement, the liquid connection is established and liquid may flow at a pressure head that is approximately equal to a fictional liquid level at the height of the air outlet 123. While the liquid level L drops the liquid pressure head may remain approximately the same, assuming that the height level of the air outlet 123 does not vary.

Figure 3:
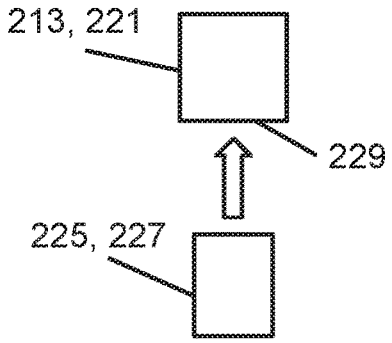
FIG. 3 illustrates a diagram of an example of a tower and a seal structure before connection.
Figure 4:
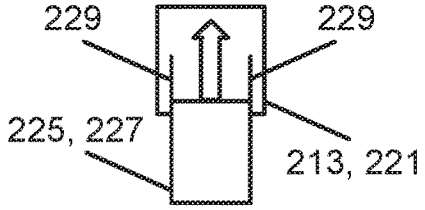
FIG. 4 illustrates a diagram of an example of a tower and a seal structure during or after connection.

FIGS. 3 and 4 each show a tower 225, 227 and a corresponding reservoir port 213, 221 before and after installation, respectively. Perhaps redundant to mention, the towers, ports and seals of FIGS. 3 and 4 could be applied to the examples of FIGS. 1, 2, 5 and 6. The reservoir port 213, 221 may be a liquid outlet or an air inlet as discussed elsewhere in this disclosure. The tower 225, 227 may be a liquid inlet tower or an air outlet tower as discussed elsewhere in this disclosure. In FIG. 3, a seal structures 229 seals the reservoir port 213 thereby maintaining a vacuum in the reservoir. The seal structure 229 includes at least one air and vapor barrier layer. The seal structure 229 may be welded or adhered to its port 213, 221. As can be seen by FIG. 4, the seal structure 229 opens by a push force of the tower 225, 227. At opening, the vacuum in the reservoir is broken after which air may enter the air inlet and liquid may exit the liquid outlet.

In one example the seal structure 229 allows for piercing it open, for example by a prong-type tower 225, 227. The seal structure 229 may include a relatively thin air and liquid barrier film to facilitate rupturing of the seal. Instead, or in addition, the tower 225, 227 may include an edge that is adapted to break or rupture the seal structure 229. In another example the seal structure 229 includes a valve such as a ball valve that opens the respective port by pushing the ball out of its seat. In such example the tower 225, 227 may be adapted to push the ball from its seat. Other valve/seal structures may be suitable for the same purpose.

The seal structure 229 may further include a septum seal that is to seal the connection between the tower 225, 227 and port 213, 221 in an air and liquid tight manner. The septum may be of elastomeric material such as rubber or silicon. The complete seal structure may include an integral elastomer film and septum suitable to be seal around the tower 225, 227 after rupture.

Figure 5:
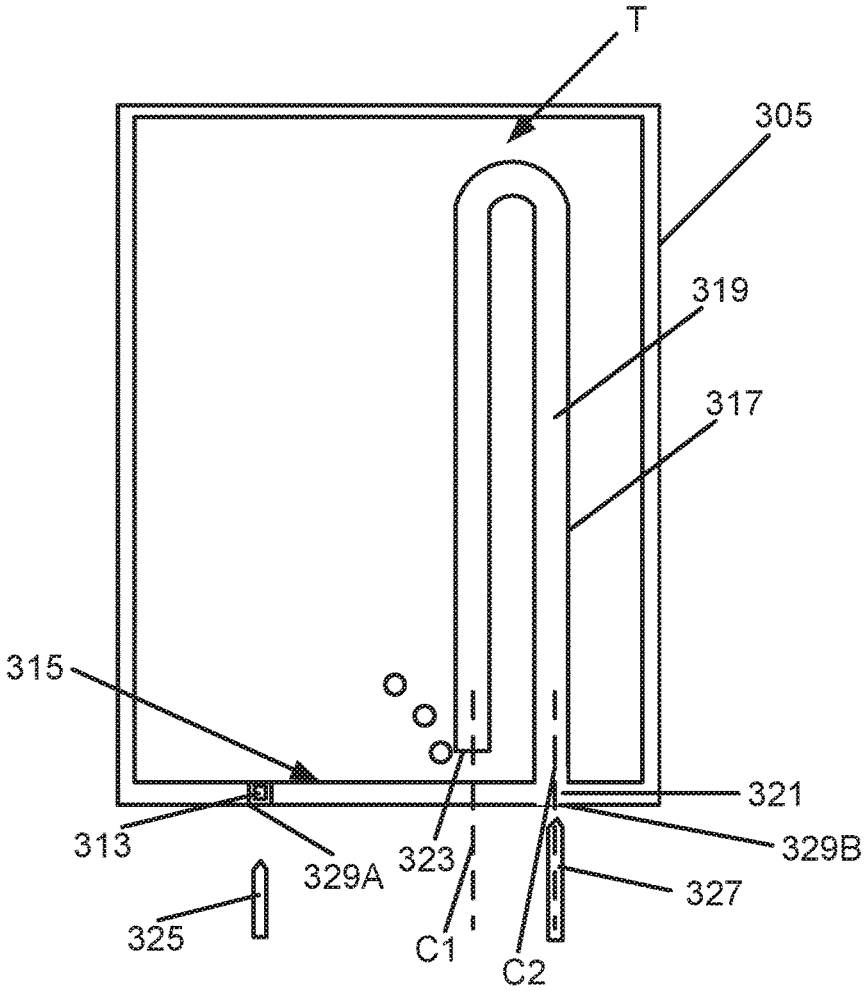
FIG. 5 illustrates a diagram of an example liquid reservoir and two towers.

FIG. 5 illustrates an example of a liquid reservoir 305 and two prong-shaped towers 325, 327. The towers 325, 327 pertain to a receiving structure of a liquid dispense system. The reservoir 305 is to fluidically connect to the towers 325, 327. A first tower 325 is a liquid inlet tower. A second of the towers is an air outlet tower 327. The air outlet tower 327 may project further out than the liquid tower 325 to open a bubbler seal before opening a liquid outlet seal of the reservoir. In one example one or both of the towers 325, 327 may include a pointy end for rupturing the seal.

The reservoir 305 includes a liquid outlet 313 and an air inlet 315 near a bottom 315 of its inner volume, to let liquid out and air in, respectively. Both are sealed by seals 329A, 329B, respectively. The seals 329A, 329B, as well as the reservoir walls that define the inner volume, include a liquid and air barrier layer to facilitate maintaining a vacuum in the reservoir 305 as well as preventing vapor loss. During installation, the seals 329A, 329B may be ruptured by each of the towers 325, 327, respectively, for example as discussed above with reference to FIGS. 3 and 4.

The bubbler structure 317 includes an air channel 319. Extreme ends of the air channel 319 form the air inlet 321 and an air outlet 323. The air outlet 323 extends in the inner volume of the reservoir 305, just above its bottom 315. Central axes C1, C2 of the air outlet 323 and inlet 321 may extend approximately vertically, at least in an operational orientation, and approximately parallel to each other.

The air channel 319 of the bubbler structure 317 makes a 180 degrees turn T. The bubbler structure 317 may be tube-shaped, extending from the air inlet 321 almost up to a ceiling of the inner volume, from there make a turn over approximately 180 degrees, close to the ceiling, and extend downwards up to the air outlet 323 just above the bottom 315. The example bubbler tube exhibits a U-shape. In one example, the extreme ends of the tube that form the inlet 321 and outlet 323 of the bubbler structure 317 point downwards, in an operational and installed condition of the reservoir 305. Air channels having similar functions could also have other shapes such as coil shapes, M-shapes, etc.

When filling and sealing the reservoir 305, for example before shipment or usage, a space may be left without liquid that has at least the volume of the bubbler air channel 319. For example, before opening an inner volume of the reservoir 305 may be at least 80, 90 or 95% full of liquid. During installation, when opening the air inlet's seal structure 329B, air enters the bubbler structure 317, replacing the vacuum, and setting a pressure head of the liquid in the reservoir 305 to the level of the air outlet 323. The air tower 327 is higher than the liquid tower 325 to set the bubbler function before establishing the liquid connection between the liquid tower 325 and the liquid outlet 313.

Figure 6:
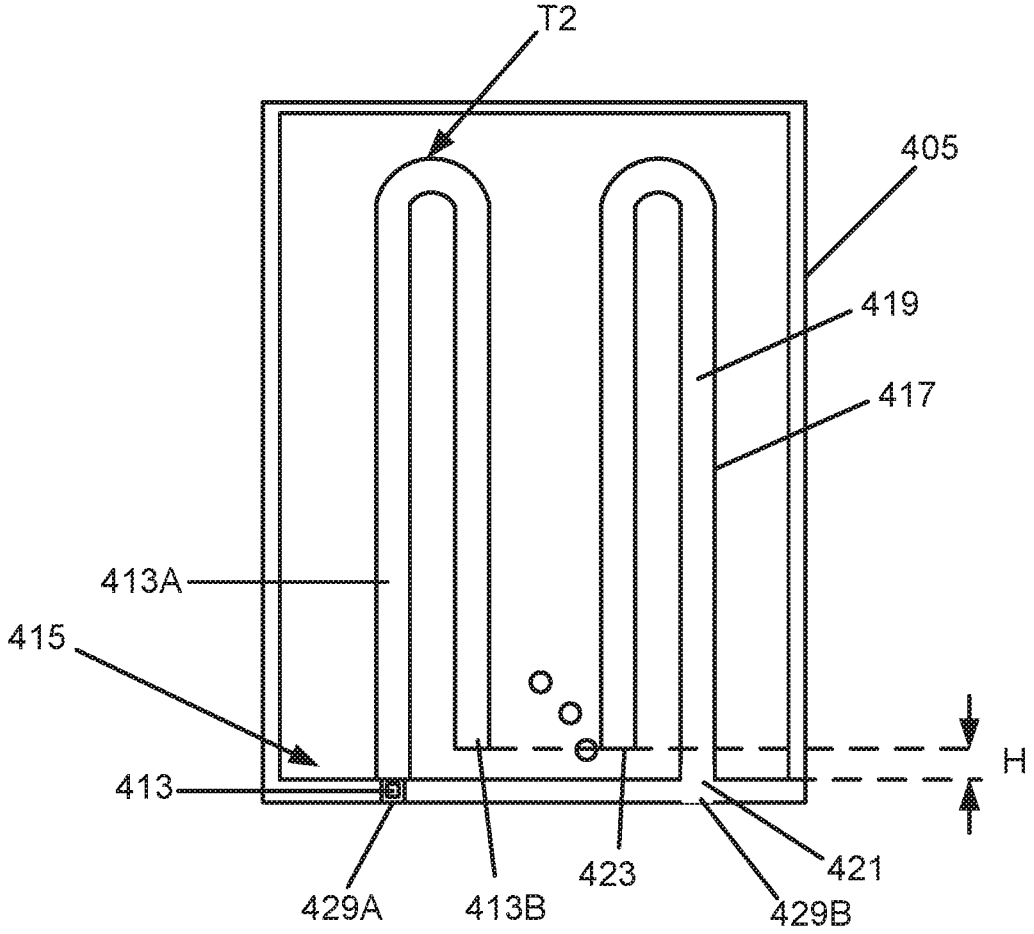
FIG. 6 illustrates a diagram of another example liquid reservoir.

FIG. 6 illustrates an example reservoir 405 similar to the reservoir 305 of FIG. 5. The reservoir 405 of FIG. 6 includes an elongate liquid outlet structure wherein the liquid outlet 413 is disposed at one extreme of the liquid outlet structure 413A. The liquid outlet structure 413A includes an elongate liquid channel that connects the liquid outlet 413 to an inner liquid inlet 413B disposed at the other extreme of the liquid outlet structure 413A.

The liquid outlet structure 413A, or at least its liquid channel, may be shaped like a syphon, for example including a U-shaped, coil-shape, or the like. For example, in operation liquid flows into the inlet 413B upwards, away from the bottom 415, make an approximately 180 degrees turn (T2) at the top of the structure 413A and flow downwards again toward the bottom 415, out of the reservoir 405. The inner liquid inlet 413B may be disposed at the same height level H as the air outlet 423. The air outlet 423 may be connected to ambient air through the bubble structure 417. Hence, at said height level H liquid may exiting through the outlet structure 413A under a steady, approximately ambient pressure, until the liquid's top surface passes under said level H.

Figure 7:
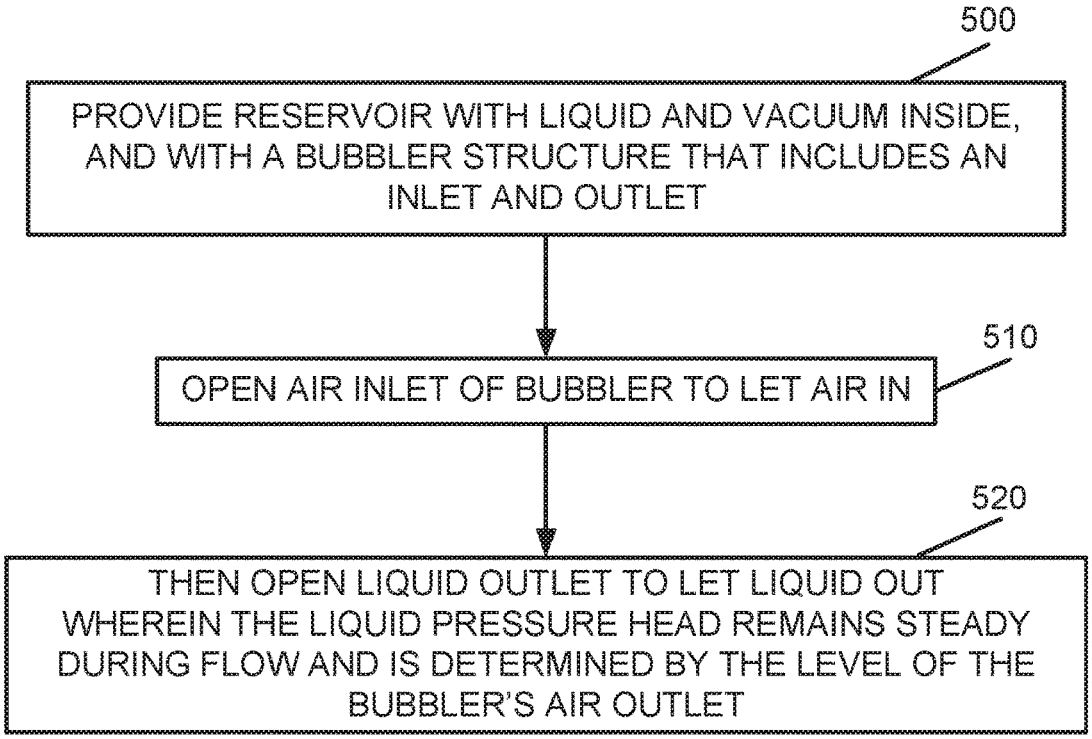
FIG. 7 illustrates a flow chart of an example of a method of installing a liquid reservoir to a print system.

FIG. 7 illustrates a flow chart of an example of a method of installing a print liquid reservoir to a print system. The print liquid reservoir includes print liquid and some empty, vacuum space. The method includes providing for the partly filled reservoir, wherein the reservoir further includes a bubbler structure that has an air inlet to let outside air in and an air outlet to let the air flow into an inner volume of the reservoir (block 500). The air outlet may be disposed just above a bottom of the inner volume. The method further includes, first, exposing a previously vacuum sealed air bubbler inside the print liquid reservoir to external air by opening its air inlet (block 510). The method includes, after opening that air inlet, opening a liquid outlet of the reservoir to let liquid out (block 520), wherein the pressure head of the liquid in the reservoir remains approximately steady during flow and is equal to the liquid volume from the bottom up to the height level of the air outlet.

Figure 8:
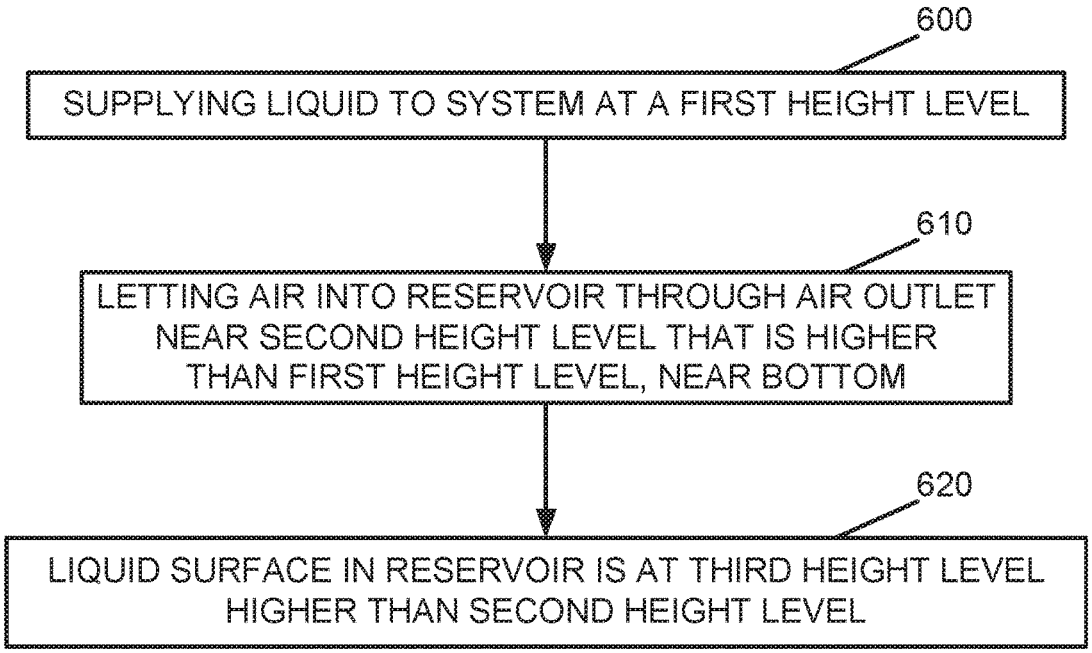
FIG. 8 illustrates a flow chart of an example of a method of printing.

FIG. 8 illustrates a flow chart of an example of a method of printing. The printing may involve printing through printhead nozzles. In an example the method of FIG. 8 may follow after the installation steps of FIG. 7. The method of FIG. 8 includes supplying liquid to a print system from a print reservoir at a first height level (Block 600), for example through a liquid outlet near a bottom of the reservoir. The method further includes letting air into an inner volume of the reservoir through an air outlet near a second height level that is slightly higher than the first height level but still near the bottom of the reservoir (block 610). In theory the air outlet could be placed at any second level higher than the first level but if the second level would be much higher than the first level this could cause a pressure increase which in certain circumstances may not be desirable. Hence the second height level is said to be only "slightly" higher than the first height level, or, phrased differently but along the same lines "just above" the bottom. For illustrative purposes, in a reservoir of at least 0.3 liters, the air outlet could extend a couple of millimeters or centimeters above the bottom, such as between 2 and 50 millimeters or between 3 and 40 millimeters or between 3 and 30 millimeters. The method further includes a top surface of the liquid in the reservoir being at a third height level that is higher than the second level (block 620). The third level may decrease during printing. The second level remains constant. The pressure head of the liquid in the reservoir that is supplied to the print system during printing may depend on the second level, and may therefore remain relatively steady.

Figure 9:
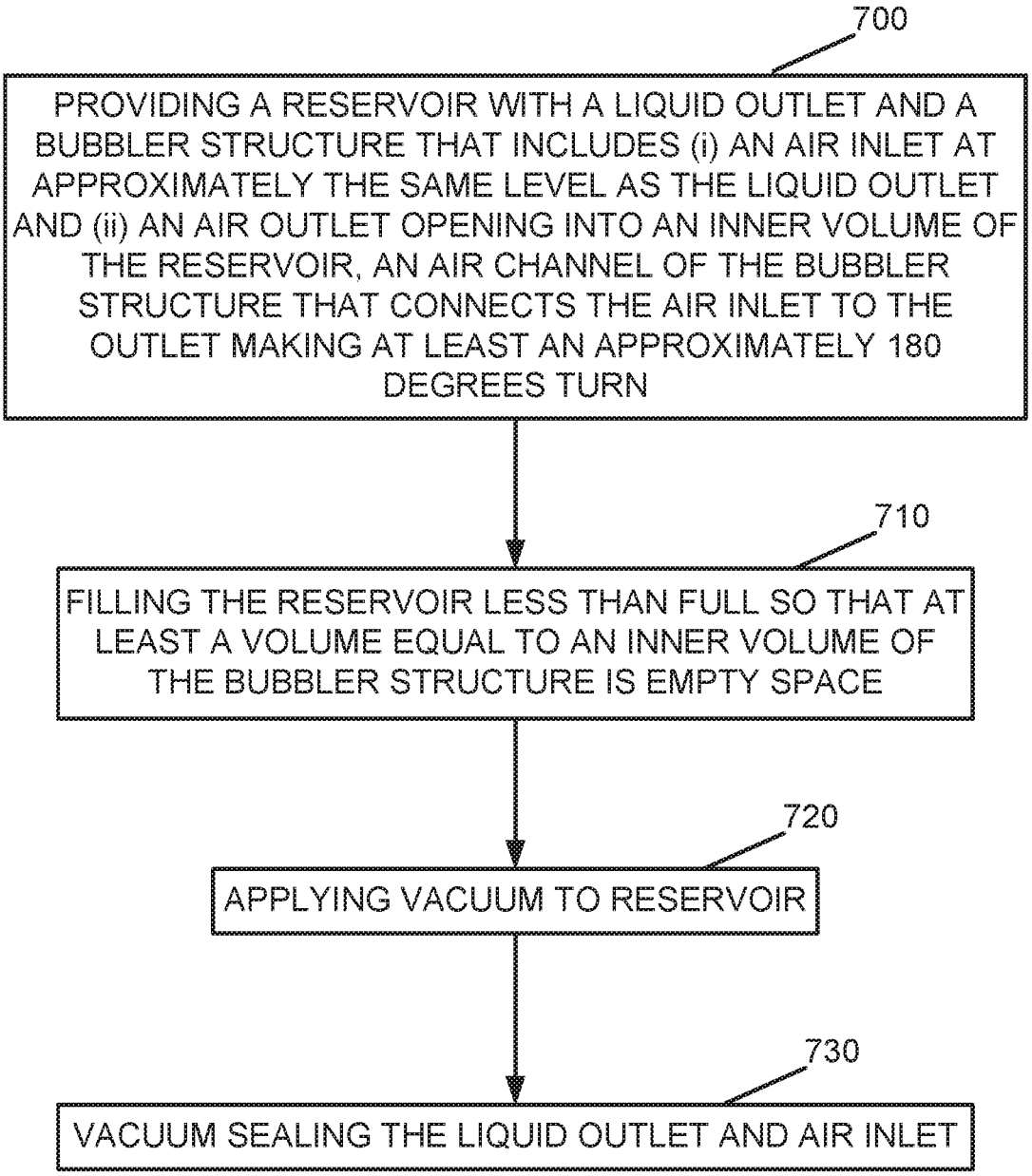
FIG. 9 illustrates a flow chart of an example of a method of filling a print liquid reservoir.

FIG. 9 illustrates a flow chart of an example of a method of filling a print liquid reservoir. The method includes providing a reservoir with a liquid outlet and a bubbler structure that includes an air inlet at approximately the same level as the liquid outlet and an air outlet opening into an inner volume of the reservoir, wherein an air channel of the bubbler structure that connects the air inlet to the outlet makes at least an approximately 180 degrees turn (block 700). The air outlet may form an extreme end the bubbler structure and may extend close to the bottom of the inner volume of the reservoir where the liquid outlet and air inlet may be located. The method includes filling the reservoir less than full so that at least a volume equal to an inner volume of the bubbler structure is empty space (block 710). The method includes applying a vacuum to the reservoir (block 720). The method includes sealing the liquid outlet and the air inlet (block 730) whereby after sealing the vacuum is maintained.

The examples discussed in this disclosure may involve replaceable relatively high volume reservoirs that facilitate installation into a print system in a relatively spill free, simple and reliable manner wherein before and during printing a pressure head may be maintained steady, for example at a suitably low level, which in turn may prevent liquid leaking from a printhead downstream of the reservoir. Such print system and reservoir may facilitate that, for example, the print reservoir may not necessarily need to extend vertically below the printhead nozzles. In another example, rather than pouring liquid into a fixed tank with associated spill risk, the reservoir may be connected and remain in place during printing. In other examples it may not be necessary to include additional pressure regulating components in the liquid delivery system.

In this disclosure printing may refer to printing ink or agents through nozzle arrays or a printhead at a downstream end of a liquid delivery system. Nozzle arrays may be arranged in high packing densities of approximately 300 nozzles per inch or more, for example approximately 600, 900 or 1200 nozzles per inch or more. In one example, the reservoir may hold a high volume of ink, for example of more than 0.1, more than 0.3 or more than 0.5 liters, which could be equivalent to an amount sufficient to print at least 10.000, at least 15.000 or at least 20.000 A4 or letter size pages, based on measurement standards in the field such as ISO/IEC 24711. An assembly of the reservoir installed in the print system could be referred to as CISS. Examples of the reservoir may be replaceable, to be disposed, recycled or refilled after usage. Other examples of the reservoir could be fixed to the print system, for example fixed to the receiving structure, wherein the receiving structure is simply part of the liquid delivery system. For example the liquid dispense systems discussed herein may be intended to print during the lifetime of the system without refilling the reservoir, at least not by an end user.

It will be understood that the air inlet, air outlet, liquid outlet and liquid inlet are not necessarily limited to allowing only one-directional flow all of the time. For example, in certain environmental circumstances liquid or air may flow in an opposite direction with respect to a normal flow direction, for example for short periods of time. Environmental circumstances that could induce a different flow direction may include varying ambient pressures, system vapor losses, varying ambient temperatures, varying heights of the system with respect to sea level, etc. That said, the air inlet, air outlet, liquid outlet and liquid inlet imply a one-directional flow most of the time in normal operational conditions.

In certain example, the liquid outlet and air inlet extend in parallel and next to each other, as illustrated. In another example the liquid outlet and air inlet may extend coaxial. The liquid outlet and air inlet may have separate seal structures or a single seal structure may seal both the outlet and inlet.

What is claimed is:

1. A liquid dispense system comprising
a liquid delivery system for delivering liquid to a dispense head,
a receiving station for delivering liquid to the liquid delivery system, and
a replaceable liquid reservoir to be installed in the receiving station, the reservoir having an inner volume for holding liquid, wherein
the liquid reservoir comprises
a liquid outlet near a bottom to supply liquid to the liquid delivery system through the receiving station, and
a bubbler structure, including:
an air inlet to allow air to flow in from at least one of atmosphere and an air supply of the liquid dispense system, and
an air outlet connected to the air inlet, the outlet opening into the inner volume near a bottom of the inner volume of the reservoir, the height of the air outlet to determine the liquid pressure head;
wherein the air inlet and the liquid outlet are on the same reservoir side, and the receiving station comprises
an air throughput tower to connect to the air inlet, and
a liquid inlet tower to connect to the liquid outlet.

2. The liquid dispense system of claim 1, wherein, in an operational position of the system and an installed condition of the reservoir, the air inlet and liquid outlet are provided in a bottom of the reservoir and the towers extend vertically upwards.

3. The liquid dispense system of claim 1, wherein
the air inlet and the liquid outlet each comprise at least one seal that seals the inlet and outlet, respectively, at least before installation of the reservoir in the receiving station, and
the towers are to open the liquid outlet seal and the air inlet seal by pushing against the seal when installing the reservoir into the station.

4. The liquid dispense system of claim 3, wherein the towers are to open first the air inlet and second the liquid outlet.

5. The liquid dispense system of claim 4, wherein the air tower end point is higher than the liquid tower.

6. A print liquid reservoir to connect to a print system comprising
a liquid outlet through which liquid is to exit the reservoir; and
a bubbler structure to supply air to the inner volume of the reservoir, the bubbler structure comprising
an air inlet, and
an air outlet, fluidically connected to the air inlet, the air outlet being disposed, in normal operation, above a level of the liquid outlet yet under a liquid top surface so that, in operation, a pressure head of liquid in the reservoir is achieved based on a height of the air outlet above a bottom surface of the inner volume of the reservoir.

7. A print liquid reservoir of claim 6, wherein part of an air channel between the air inlet and air outlet extends in the inner volume of the reservoir above both the air inlet and air outlet.

8. The print liquid reservoir of claim 6, wherein the bubbler structure comprises an air channel that extends vertically from the air inlet, includes a 180 degrees turn, and returns to the air outlet.

9. The print liquid reservoir of claim 6, wherein the air inlet and the air outlet point downwards, in normal operation, and have approximately parallel central axes.

10. The print liquid reservoir of claim 6, wherein the air inlet and liquid outlet are provided in a wall of the reservoir that forms a bottom of the reservoir in an operational and installed condition of the reservoir.

11. The print liquid reservoir of claim 6, wherein
vacuum and print liquid are contained in an inner volume of the reservoir;
a liquid seal seals the liquid outlet;
an air seal seals the air inlet;
a bubbler structure has an air channel between the air inlet and air outlet, the air channel having an air channel inner volume;
a volume of the vacuum is at least the air channel inner volume, and
reservoir walls and the seals form air/vapor barriers.

12. The print liquid reservoir of claim 11, wherein
a liquid seal seals the liquid outlet; and
an air seal seals the air inlet;
wherein the seals are arranged to open by a pushing force against the seal.

13. The print liquid reservoir of claim 12, wherein each seal includes at least one of
a break film, and
a push-open valve.

14. A print liquid reservoir for providing print liquid to a print system through a liquid outlet, the reservoir having:
a bubbler structure that includes
an air inlet for letting outside air in and
an air outlet for letting air bubbles into an inner volume of the reservoir
wherein the liquid outlet and the air inlet are both disposed in a bottom of the reservoir in an operational orientation of the reservoir.

15. The print liquid reservoir of claim 14, wherein the air outlet is disposed above the bottom of the reservoir, the air inlet and air outlet being connected by an U-shaped air channel that extends upward into the reservoir from the bottom of the reservoir.

16. The print liquid reservoir of claim 15, further comprising a second U-shaped air channel between the liquid outlet and a location within the reservoir adjacent the air outlet.

17. Method of installing a print liquid reservoir into a print system wherein the reservoir is partly filled with print liquid and partly vacuum, comprising first, expose a previously vacuum sealed air bubbler inside the reservoir to external air by opening its air inlet, allowing air bubbles to pass into the reservoir through an air outlet of the bubbler, and second, open a liquid outlet of the reservoir to let print liquid out, wherein a level of the air outlet of the bubbler determines a liquid pressure head in the reservoir.

18. Method of printing comprising, first installing the reservoir to the print system according to the method of claim 17, and then, supplying liquid near a bottom of the reservoir at a first height level, letting air into the reservoir through the air outlet near a second height level that is slightly higher than the first height level but still near said bottom of the reservoir, and wherein the liquid surface in the reservoir is at a third height level higher than the second level.

19. Method of printing of claim 18 wherein the pressure head of the liquid in the reservoir remains relatively steady while the third level drops.

20. Method of filling a print liquid reservoir, comprising providing a reservoir with a liquid outlet and a bubbler structure that includes an air inlet at the same level as the liquid outlet and an air outlet opening into an inner volume of the reservoir, an air channel of the bubbler structure that connects the air inlet to the outlet making at least an approximately 180 degrees turn, filling the reservoir less than full so that at least a volume equal to an inner volume of the bubbler structure is empty space, applying a vacuum, and vacuum sealing the liquid outlet and air inlet.

* * * * *